US009338532B2

(12) United States Patent
Yan

(10) Patent No.: US 9,338,532 B2
(45) Date of Patent: May 10, 2016

(54) SUSPENSION AND SPEAKER USING SAME

(71) Applicant: XuDong Yan, Shenzhen (CN)

(72) Inventor: XuDong Yan, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 240 days.

(21) Appl. No.: 14/022,290

(22) Filed: Sep. 10, 2013

(65) Prior Publication Data

US 2014/0079253 A1 Mar. 20, 2014

(30) Foreign Application Priority Data

Sep. 14, 2012 (CN) ..... 2012 2 0466986 U

(51) Int. Cl.

| | |
|---|---|
| ***H04R 25/00*** | (2006.01) |
| ***H04R 1/00*** | (2006.01) |
| ***H04R 7/16*** | (2006.01) |
| ***H04R 1/06*** | (2006.01) |
| ***H04R 9/04*** | (2006.01) |
| *H04R 9/06* | (2006.01) |

(52) U.S. Cl.

CPC .. *H04R 1/00* (2013.01); *H04R 1/06* (2013.01); *H04R 7/16* (2013.01); *H04R 9/043* (2013.01); *H04R 9/06* (2013.01)

(58) Field of Classification Search

CPC ..... H04R 9/06; H04R 1/06; H04R 9/043; H04R 31/006; H04R 7/16; H04R 9/025; H04R 2499/11; H04R 31/00; H04R 7/20; H04R 9/045; H04R 1/00; H04R 1/023; H04R 1/1016; H04R 1/24; H04R 2201/34; H04R 2205/022; H04R 2231/003; H04R 2307/207; H04R 2400/11; H04R 2499/15; H04R 25/00; H04R 5/02; H04R 7/10; H04R 7/127; H04R 7/18; H04R 9/00; H04R 9/02; H04R 9/04; H04R 9/063; H04R 9/10; H04M 1/03

USPC ..... 381/400, 403, 404, 405, 409, 413, 423, 381/396, 398, 162; 181/167, 171, 172, 199

See application file for complete search history.

(56) References Cited

U.S. PATENT DOCUMENTS

| | | | | | |
|---|---|---|---|---|---|
| 4,239,944 | A * | 12/1980 | Obara et al. | ..... | 181/171 |
| 4,313,040 | A * | 1/1982 | Tsukamoto | ..... | 381/425 |
| 4,357,498 | A * | 11/1982 | Tsuchiya et al. | ..... | 381/186 |
| 5,757,945 | A * | 5/1998 | Sakamoto | ..... | 381/400 |
| 5,850,462 | A * | 12/1998 | Sakamoto et al. | ..... | 381/405 |
| 7,082,667 | B2 * | 8/2006 | Auerbach et al. | ..... | 29/594 |
| 7,289,642 | B2 * | 10/2007 | Chen | ..... | 381/396 |

(Continued)

*Primary Examiner* — Davetta W Goins
*Assistant Examiner* — Phylesha Dabney
(74) *Attorney, Agent, or Firm* — IPro, PLLC; Na Xu

(57) ABSTRACT

Disclosed is a speaker having a suspension. The suspension includes a vibrating arm having at least a pair of layer structures and an insulating layer sandwiched between the two layer structures. Each layer structure has a foil signal transmission layer, a hardness reinforcement layer and a glue layer for connecting the foil signal transmission layer with the hardness reinforcement layer and a conductive portion for electrically connecting the foil signal transmission layers of each of layer structures. The suspension of the disclosure can prevent the signal layer from being broken. The suspension disclosed has at least two layer structures, which makes the signal transmitted in each layer structures at the same time, even if one of the layer structures is broken, the rest of the layer structures can still be working.

8 Claims, 4 Drawing Sheets

(56) References Cited

U.S. PATENT DOCUMENTS

| | | | | |
|---|---|---|---|---|
| 8,170,267 | B2 * | 5/2012 | Kim et al. | 381/396 |
| 2002/0094106 | A1 * | 7/2002 | Shingu | 381/404 |
| 2004/0008860 | A1 * | 1/2004 | Wu | 381/404 |
| 2006/0188126 | A1 * | 8/2006 | Andersen et al. | 381/396 |
| 2007/0071274 | A1 * | 3/2007 | Andersen et al. | 381/404 |
| 2007/0189576 | A1 * | 8/2007 | Chan | 381/404 |
| 2010/0046788 | A1 * | 2/2010 | Harris et al. | 381/404 |

* cited by examiner

SUSPENSION AND SPEAKER USING SAME

FIELD OF THE INVENTION

The disclosure described herein relates generally to speakers, and more particularly, to a speaker having a suspension.

DESCRIPTION OF RELATED ART

In order to adapt the miniaturization development of the stereo equipment and the communication equipment, speakers used in these equipments need to possess more compact structure. More particularly, with the lightening and thinning development trend of the mobile phone, the size of the speaker used therein needs to be smaller.

Generally, a related speaker comprises a vibrating system, a supporting system and a magnetic circuit system. The vibrating system comprises a voice coil member, a film driven by the voice coil member and a suspension connected to the film. The magnetic circuit system comprises a permanent magnet, the voice coil member would move in a linear fashion due to the attraction and repulsion between the electromagnetic force formed by the electrical current and the permanent magnet. With the moving of the voice coil member, the film is vibrating at the same time. The suspension can play a role of supporting the film. Traditional suspension is annular shaped, not conductive and usually has a large size. Instead of using traditional suspension of the speaker, an FPC (Flexible Printed Circuit) is more and more widely used in the speaker because of its conductivity and thin structure.

The commonly used suspension usually comprises a single foil signal transmission layer enwrapped by insulating material, once the foil signal transmission layer is snapped, the signal transmission will be interrupted. So it is necessary to apply a new structure to solve above problem.

Figure 1:
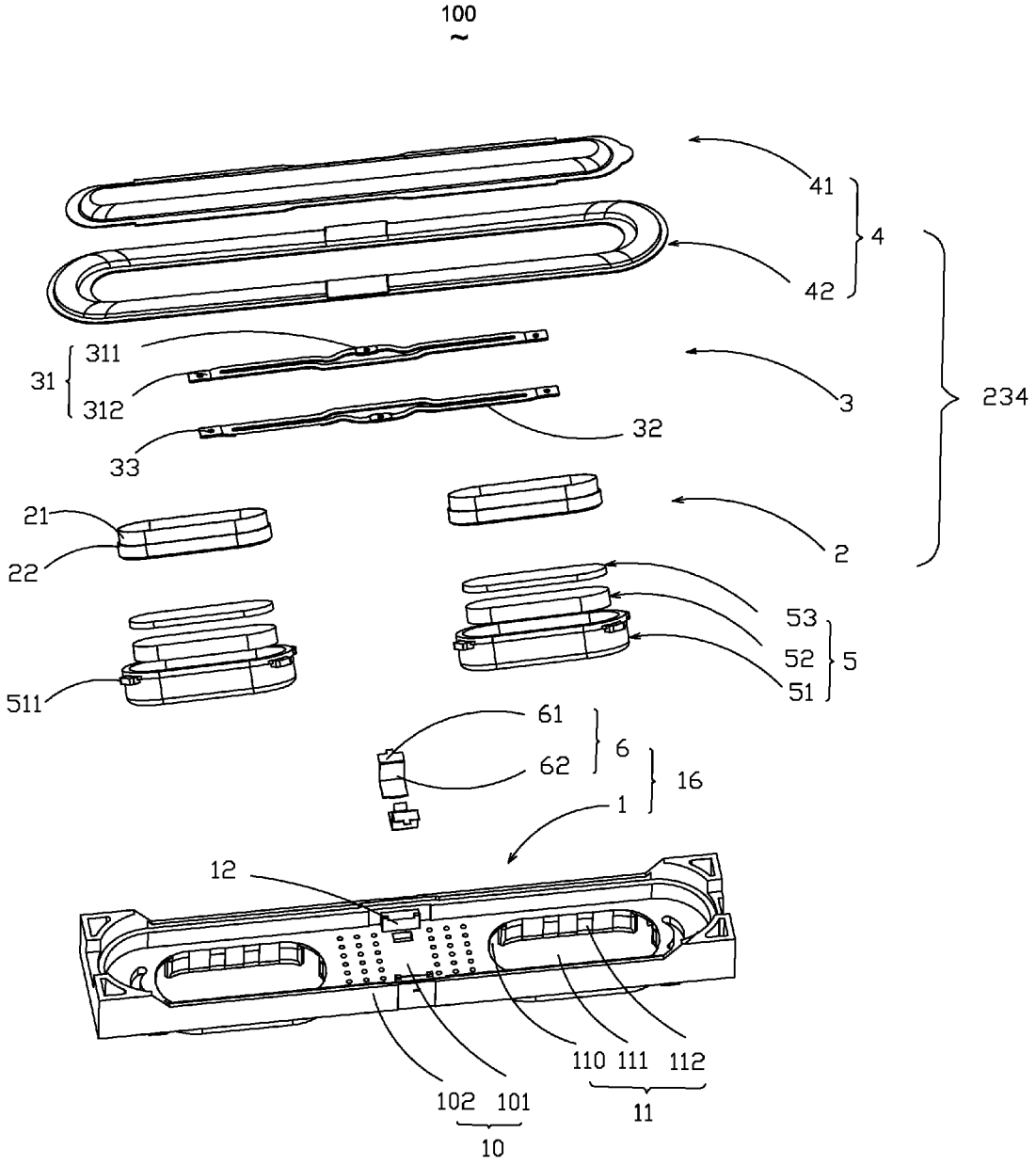
FIG. 1 is an illustrative exploded view of a speaker in accordance with a first exemplary embodiment of the present invention.

Many aspects of the embodiments can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Reference will now be made to describe the exemplary embodiments of the present invention in detail.

Referring to FIGS. 1-5 a speaker 100 in accordance with an first exemplary embodiment of the present invention comprises a vibrating system 234, a supporting system 16 and a pair of magnetic circuit systems 5. Every magnetic circuit system 5 includes a magnetic bowl 51, a magnet 52 located in the magnetic bowl 51 and a pole plate 53 covering on the magnet 52. The vibrating system 234 includes a pair of voice coil members 2 separated from each other, a film 4 driven by the voice coil members 2 and a pair of suspensions 3 respectively connected with the film 4 and located at opposite sides of the voice coil members 2. The film 4 includes a dome 41 and a diaphragm 42 connected with the dome 41. The supporting system 16 includes a frame 1 and a pair of terminals 6 assembled with the frame 1.

Referring especially to FIG. 1, the frame 1 comprises a frame body 10. The frame body 10 comprises a bottom 101, a side wall 102 vertically extending from the bottom 101 toward the bottom 101 and a pair of receiving grooves 11 formed by the bottom 101 together with the side wall 102 and separated from each other. Each receiving groove 11 comprises an opening 111 through the bottom of the frame body 10 and communicating with the receiving groove 11, and a surrounding wall 112 vertically extending away from the bottom 101 toward the vibrating system 234 for surrounding the opening 111. The surrounding wall 112 has a plurality of clamp-receiving grooves 110. The frame 1 further comprises a pair of inserting blocks 12 extending from the side wall 102 towards the bottom 101 for receiving the terminals 6.

Each terminal 6 includes a fixing portion 62 accommodated in the inserting block 12 and a pair of extending portions 61 vertically extending from both ends of the fixing portions 62. The terminals 6 are capable of respectively transmitting external signals to the suspensions 3.

Figure 2:
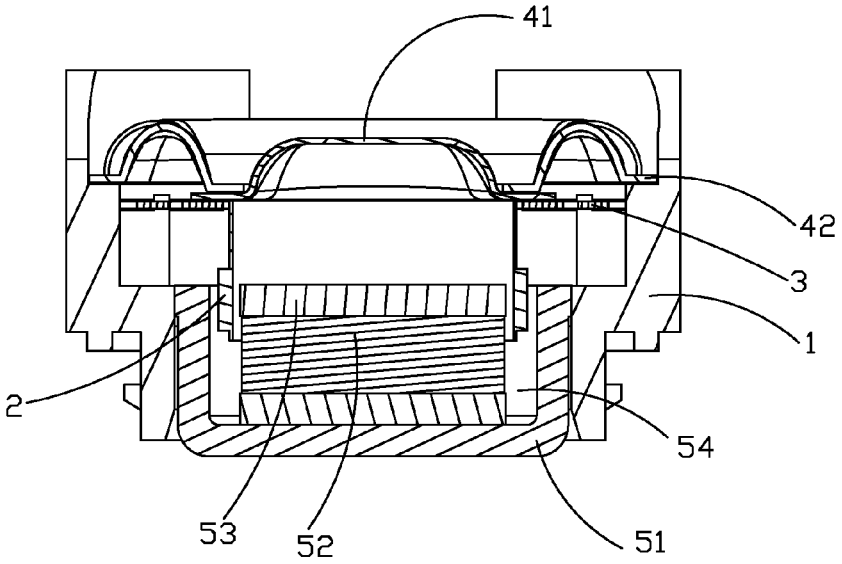
FIG. 2 is an illustrative cross-sectional view of the speaker in FIG. 1.

Referring to FIGS. 1 and 2, the magnetic circuit systems 5 are mounted in the receiving grooves 11 respectively. A space between an inner surface of the magnetic bowl 51 and an outer surface of the magnet 52 forms a magnetic gap 54 for receiving one end of the voice coil member 2. The magnetic bowl 51 has a plurality of fixing pins clamped with the clamp-receiving grooves 110 for fixing the magnetic bowl 51 on the frame 1.

Each voice coil member 2 has a holder 21 and a voice coil 22 wounded around the holder 21. One end of the voice coil 22 is connected to the dome 41 which makes it possible for the voice coil members 2 to connect with the film 4.

Figure 3:
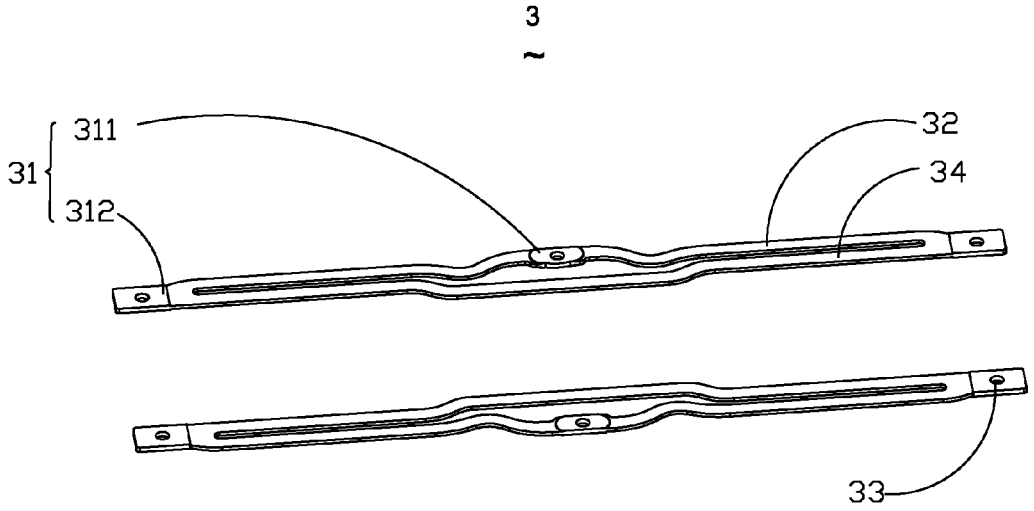
FIG. 3 is an illustrative isometric view of a suspension of the speaker in FIG. 1.

Referring to FIGS. 2 and 3, each suspension 3 has a contacting end 31. The contacting end 31 includes a first contacting end 311 for connecting the terminals 6 and a pair of second contacting ends 312 set space with respect to the contacting end 311. The suspension 3 further includes a pair of vibrating arms 32 for connecting the first contacting end 311 with the second contacting ends 312 and a connecting arm 34 for connecting the second contacting ends 312 respectively. In order to support the voice coil members 2 elastically, the vibrating arms 32 are separated from the connecting arm 34. The connecting arm 34 contacting with the dome 41 makes it possible for the suspension 3 connecting with the film 4. The voice coil members 2 have lead wires. The lead wires of the voice coil members 2 are connected to the corresponding second contacting ends 312, which makes the external power, the vibrating arms 32 and the voice coil members 2 form dual closed circuits. Significantly, In this embodiment, the speaker has dual second contacting ends to form dual closed circuits. In an alternative embodiment, the speaker has one second contacting end and one vibrating arm connecting the first contacting end and the second contacting for forming one closed circuit. Or the speaker includes one magnetic circuit system and one voice coil member, so the suspension designs one second contacting end and one vibrating arm. Besides, the connecting arm can be omitted, that is to say, the vibrating arms directly contacts with the dome 41. Additionally, in this embodiment, the voice coil member is connected to the film 4 directly. But in other optional embodiment, the voice coil member can be directly connected to the suspension and the film 4 is driven by the suspension.

Figure 4:
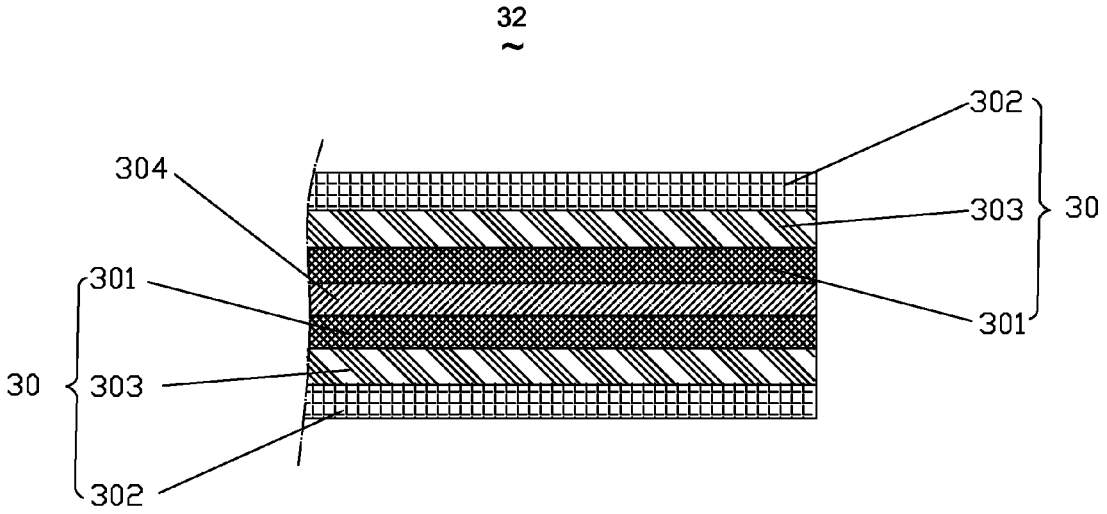
FIG. 4 is an illustrative cross-sectional view of a vibrating arm of the suspension in FIG. 3.

Referring to FIG. 4, each vibrating arm 32 includes at least a pair of layer structures 30 and a insulating layer 304 sandwiched between the two layer structures 30. Each layer structure 30 includes a foil signal transmission layer 301, a hardness reinforcement layer 302 and a glue layer 303 for gluing the foil signal transmission layer 301 with the hardness reinforcement layer 302. Generally, the insulating layer 304 and the hardness reinforcement layer 302 are made of the same material. An outer surface of the vibrating arm 32 is hardness reinforcement layer 302. That is to say, when the suspension 3 has a pair of layer structures 30, the suspension is composed by the hardness reinforcement layer 302, the glue layer 303, the foil signal transmission layer 301, insulating layer 304, the foil signal transmission layer 301, glue layer 303 and the hardness reinforcement layer 302 from above to below. Significantly, when the hardness reinforcement layer 302 is adjacent to the insulating layer 304, the hardness reinforcement layer 302 is integral with the insulating layer 304

Figure 5:
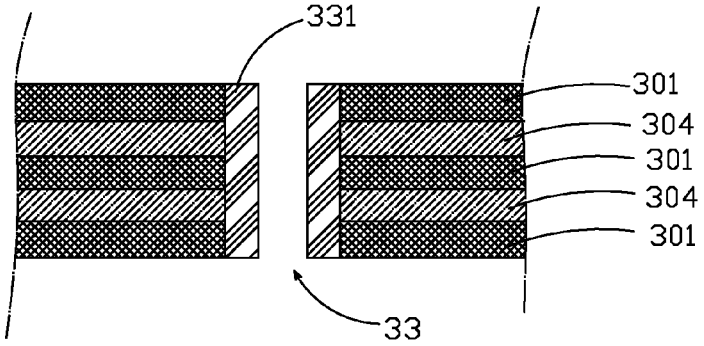
FIG. 5 is an illustrative cross-sectional view of a contact end of the suspension in FIG. 3.

Referring to FIG. 5, the first contacting end 311 and the second contacting end 312 both have a conductive hole 33 and a conductive portion 331 mounted around on an inner surface of the conductive hole 33 for electrically connecting the foil signal transmission layer 301 of each of layer structures 30, so all the layer structures 30 are electrically connected by the conductive portion 311. In other optional embodiment, the conductive hole can be a blind-hole, a conductive portion is connected with the insulating layers of each of the layer structures and is connected at least two foil signal transmission layer.

Figure 6:
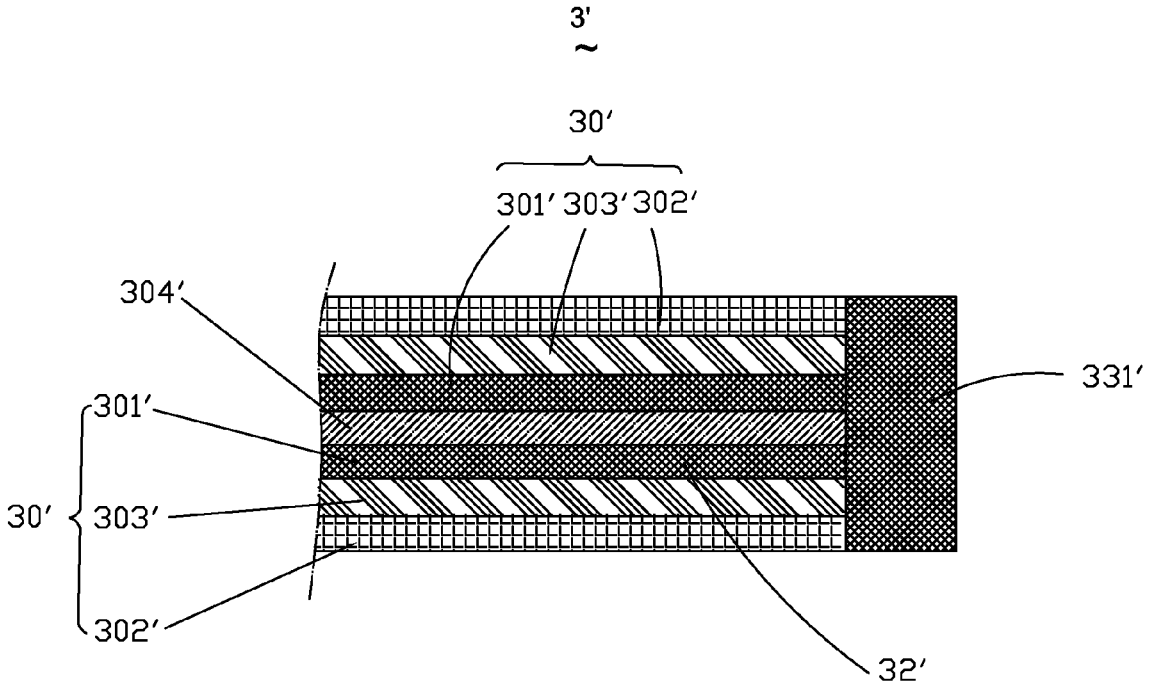
FIG. 6 is an illustrative cross-sectional view of a suspension of a speaker in accordance with a second embodiment of the present invention.

FIG. 6 is a cross-sectional view of a second embodiment illustrating a suspension of a speaker illustrated in FIG. 1. In this embodiment, the suspension 3' includes a vibrating arm 32' and a conductive portion 331' connected to the vibrating arm 32'. The structure of the vibrating arm 32' is the same with that of the vibrating arm 32 in the first embodiment, it includes at least two layer structures 30' and a insulating layer 304' sandwiched between the two layer structures 30'. Any of the layer structures 30' includes a foil signal transmission layer 301', a hardness reinforcement layer 302' and a glue layer 303' for gluing the foil signal transferring layer 301' and the hardness reinforcement layer 302'. The conductive portion 331' is a single layer made of conductive material and all the foil signal transmission layers 301' of the layer structure 30' are connected to the conductive portion 331' so that achieving the electrically connection of the foil signal transmission layers 301' of each of the layer structures 30'.

The suspension disclosed by the present disclosure has at least two layer structures, which making the signal transmitted in each layer structures at the same time, even if one of the layer structures is broken, the rest of the layer structures can still be working. So the risks of the breaking of the suspension are reduced.

While the present disclosure has been described with reference to the specific embodiments, the description of the disclosure is illustrative and is not to be construed as limiting the disclosure. Various of modifications to the present disclosure can be made to the exemplary embodiments by those skilled in the art without departing from the true spirit and scope of the disclosure as defined by the appended claims.

What is claimed is:

1. A suspension, comprising:

a pair of vibrating arms having at least a pair of layer structures and an insulating layer sandwiched between the two layer structures, each layer structure having a foil signal transmission layer, a hardness reinforcement layer and a glue layer for connecting the foil signal transmission layer with the hardness reinforcement layer;

a conductive portion for electrically connecting the foil signal transmission layers of each of layer structures, and a contacting end comprising a first contacting end; and a pair of second contacting end located on two sides of the first contacting end and located on two sides of the first contacting end, the contacting end extending from the foil signal transmission layers and the insulating layers along an extending direction of the vibrating arm, the contacting end has a conductive hole, the conductive portion being mounted on the inner sidewall of the conductive hole, the pair of vibrating arms connecting the first contacting end with the pair of the second contacting ends respectively.

2. The suspension as described in claim 1, wherein an outer surface of the vibrating arm is the hardness reinforcement layer.

3. The suspension as described in claim 1, wherein the insulating layer and the hardness reinforcement layer are made of the same material.

4. The suspension as described in claim 1, wherein, the suspension further comprises a connecting arm for connecting the pair of the second contacting ends respectively and set space from the vibrating arm.

5. A speaker comprising:

a vibrating system including a pair of voice coil members, a film driven by the voice coil members, and a pair of suspensions respectively connected with the film and located both sides of the voice coil members;

the suspension comprising a pair of vibrating arms comprising at least a pair of layer structures and a insulating layer sandwiched between the two layer structures, each layer structure comprises a foil signal transmission layer, a hardness reinforcement layer, a glue layer for connecting the foil signal transmission layer with the hardness reinforcement layer, a conductive portion for electrically connecting the foil signal transmission layers of each of layer structures and a contacting end connected to the vibrating arm, the contacting end extends from the foil signal transmission layers and the insulating layers along an extending direction of the vibrating arm;

the contacting end comprising a first contacting end, a pair of second contacting end separated from the first contacting end and located on two sides of the first contacting end, and a conductive hole, the conductive portion is mounted on the inner sidewall of the conductive hole; the pair of vibrating arms connecting the first contacting end with the pair of the second contacting ends respectively;

a supporting system including a frame and a pair of terminals mounted on the frame; and a pair of magnetic circuit systems each including a magnetic bowl, a magnet located in the magnetic bowl, and a pole plate covering on the magnet.

6. The speaker as described in claim 5, wherein, an outer surface of the vibrating arm is the hardness reinforcement layer.

7. The speaker as described in claim 5, wherein, the insulating layer and the hardness reinforcement layer are made of the same material.

8. The speaker as described in claim 5, wherein, the suspension further comprises a connecting arm for connecting both the pair of the second contacting ends respectively and set space from the vibrating arm.

* * * * *